US009932997B2

(12) United States Patent
Tsutsui et al.

(10) Patent No.: US 9,932,997 B2
(45) Date of Patent: Apr. 3, 2018

(54) TRIM AND TILT APPARATUS FOR MARINE VESSEL PROPULSION MACHINE AND MARINE VESSEL PROPULSION MACHINE

(71) Applicant: Showa Corporation, Gyoda-shi (JP)

(72) Inventors: Hayato Tsutsui, Haga-gun (JP); Takahiko Saito, Haga-gun (JP); Yoshimitsu Komuro, Haga-gun (JP)

(73) Assignee: SHOWA CORPORATION, Gyoda-Shi (JP)

( * ) Notice: Subject to any disclaimer, the term of this patent is extended or adjusted under 35 U.S.C. 154(b) by 0 days.

(21) Appl. No.: 15/361,241

(22) Filed: Nov. 25, 2016

(65) Prior Publication Data

US 2017/0261014 A1 Sep. 14, 2017

(30) Foreign Application Priority Data

Mar. 14, 2016 (JP) ..... 2016-049204

(51) Int. Cl.

| | |
|---|---|
| ***F15B 15/16*** | (2006.01) |
| ***B63H 20/08*** | (2006.01) |
| ***B63H 20/10*** | (2006.01) |
| ***F15B 15/14*** | (2006.01) |

(52) U.S. Cl.

CPC ..... *F15B 15/16* (2013.01); *B63H 20/08* (2013.01); *B63H 20/10* (2013.01); *F15B 15/1428* (2013.01); *F15B 15/1447* (2013.01)

(58) Field of Classification Search

CPC ..... B63H 20/08; B63H 20/10; B63H 21/26; B63H 20/12; B63H 5/20; B63H 5/125; F02B 61/00; F02B 61/04; F16F 9/14; F16F 9/18

USPC ..... 440/53, 55, 56, 61 D, 61 R

See application file for complete search history.

(56) References Cited

U.S. PATENT DOCUMENTS

| | | | | | |
|---|---|---|---|---|---|
| 5,261,843 | A | * | 11/1993 | Tsujii | B63H 20/10 440/61 R |
| 5,718,613 | A | * | 2/1998 | Nakamura | B63H 21/265 440/61 D |
| 5,876,259 | A | * | 3/1999 | Nakamura | B63H 20/10 440/56 |
| 6,062,924 | A | * | 5/2000 | Nakamura | B63H 20/10 440/55 |
| 6,309,264 | B1 | | 10/2001 | Saito | |

FOREIGN PATENT DOCUMENTS

| | | |
|---|---|---|
| JP | 2000-72088 A | 3/2000 |
| JP | 2012-86666 A | 5/2012 |

* cited by examiner

*Primary Examiner* — Lars A Olson
(74) *Attorney, Agent, or Firm* — Leason Ellis LLP

(57) ABSTRACT

There are provided a bar-shaped piston rod having one end portion attached to a marine vessel propulsion machine main body; an inner cylinder; an inner piston mounted in the other end portion of the piston rod, is accommodated in the inner cylinder, and divides a space in the inner cylinder into a fourth chamber on the one end portion side and a fifth chamber on the other end portion side; an outer cylinder accommodating the inner cylinder therein; and an outer piston covering an opening portion of one end portion of the inner cylinder in a state where the piston rod is exposed, divides a space in the outer cylinder into a second chamber on one end portion side and a first chamber on the other end portion side, and is formed with a through hole that allows the fourth chamber and the second chamber to communicate with each other.

12 Claims, 8 Drawing Sheets

TRIM AND TILT APPARATUS FOR MARINE VESSEL PROPULSION MACHINE AND MARINE VESSEL PROPULSION MACHINE

CROSS-REFERENCE TO RELATED APPLICATION(S)

The present application claims priority under 35 U.S.C. § 119 to Japanese Patent Application No. 2016-049204, filed Mar. 14, 2016. The contents of this application are incorporated herein by reference in their entirety.

BACKGROUND OF THE INVENTION

1. Field of the Invention

The present invention relates to a trim and tilt apparatus for a marine vessel propulsion machine and a marine vessel propulsion machine.

2. Description of Related Art

In the related art, an apparatus which can absorb an excessive impulsive force even when an impulsive force caused by an impact of underwater obstacles with respect to a marine vessel propulsion machine becomes excessive is suggested.

For example, a trim and tilt apparatus described in JP-A-2012-86666 includes: a housing in which a cylinder device is used while linked to one of a ship body and a marine vessel propulsion machine, and forms a trim chamber having a large diameter; a cylinder which is telescopically inserted into the trim chamber of the housing, and forms a tilt chamber having a small diameter; a trim piston having a large diameter which is fixed to an end portion of the cylinder in the trim chamber of the housing, and divides the trim chamber into a first trim chamber which is on a cylinder accommodating side, and a second trim chamber which is on a cylinder non-accommodating side; a piston rod which is used while linked to the other one of the ship body and the marine vessel propulsion machine, and is telescopically inserted into the tilt chamber of the cylinder; a tilt piston having a small diameter which is fixed to an end portion of the piston rod in the tilt chamber of the cylinder, and divides the tilt chamber into a first tilt chamber which is on a piston rod accommodating side, and a second tilt chamber which is on a piston rod non-accommodating side; and a free piston which is disposed in the cylinder nipped by the trim piston and the tilt piston, and divides the chamber into the second trim chamber and the second tilt chamber. In addition, in the trim and tilt apparatus, a communication path which allows the first trim chamber and the first tilt chamber to communicate with each other is provided in the cylinder, a shock relief valve which moves working oil of the first trim chamber and the first tilt chamber to the second tilt chamber at a set pressure, and a return valve which returns the working oil of the second tilt chamber to the first tilt chamber, are provided in the tilt piston, and an oil path which guides an inlet that is provided in the tilt piston and communicates with the first tilt chamber of the shock relief valve to the communication path that communicates with the first trim chamber at an extending end of the piston rod, is provided in the tilt piston.

In addition, in a tilt and trim apparatus described in JP-A-2000-72088, a first shock relief valve which releases an oil pressure on a tilt cylinder side to the second oil chamber side when a force in the extending direction which is equal to or greater than a predetermined value acts, is provided in the tilt piston, a liner member which is oil-tightly and slidingly in contact with an inner circumferential surface of the trim cylinder is provided on an outer circumferential surface of an upper end of the tilt cylinder, and a second shock relief valve which releases an oil pressure on a first oil chamber side to the second oil chamber side when a force in the extending direction which is equal to or greater than a predetermined value acts, is provided in the liner member.

SUMMARY OF THE INVENTION

The invention is for providing a trim and tilt apparatus for a marine vessel propulsion machine which can improve a capability of absorbing an impulsive force caused by an impact of underwater obstacles with respect to a marine vessel propulsion machine, and a marine vessel propulsion machine.

According to an aspect of the invention, there is provided a trim and tilt apparatus for a marine vessel propulsion machine including: a bar-shaped rod having one end portion that is attached to a marine vessel propulsion machine main body; a first cylinder; a first piston which is mounted in the other end portion of the rod, is accommodated in the first cylinder, and divides a space in the first cylinder into a first space on the one end portion side and a second space on the other end portion side; a second cylinder which accommodates the first cylinder therein; and a second piston which covers an opening portion of one end portion of the first cylinder in a state where the rod is exposed, divides a space in the second cylinder into a third space on the one end portion side and a fourth space on the other end portion side, and is formed with a communication hole that allows the first space and the third space to communicate with each other.

According to another aspect of the invention, there is provided a marine vessel propulsion machine including: a marine vessel propulsion machine main body which gives a propulsion force to a ship body; a bar-shaped rod having one end portion that is attached to the marine vessel propulsion machine main body; a first cylinder; a first piston which is mounted in the other end portion of the rod is accommodated in the first cylinder, and divides a space in the first cylinder into a first space on the one end portion side and a second space on the other end portion side; a second cylinder which accommodates the first cylinder therein; and a second piston which covers an opening portion of one end portion of the first cylinder in a state where the rod is exposed, divides a space in the second cylinder into a third space on the one end portion side and a fourth space on the other end portion side, and is formed with a communication hole that allows the first space and the third space to communicate with each other.

According to the invention, it is possible to improve a capability of absorbing an impulsive force caused by an impact of underwater obstacles with respect to a marine vessel propulsion machine.

DESCRIPTION OF EMBODIMENTS

Hereinafter, an embodiment of the invention will be described in detail with reference to the attached drawings.

Figure 1:
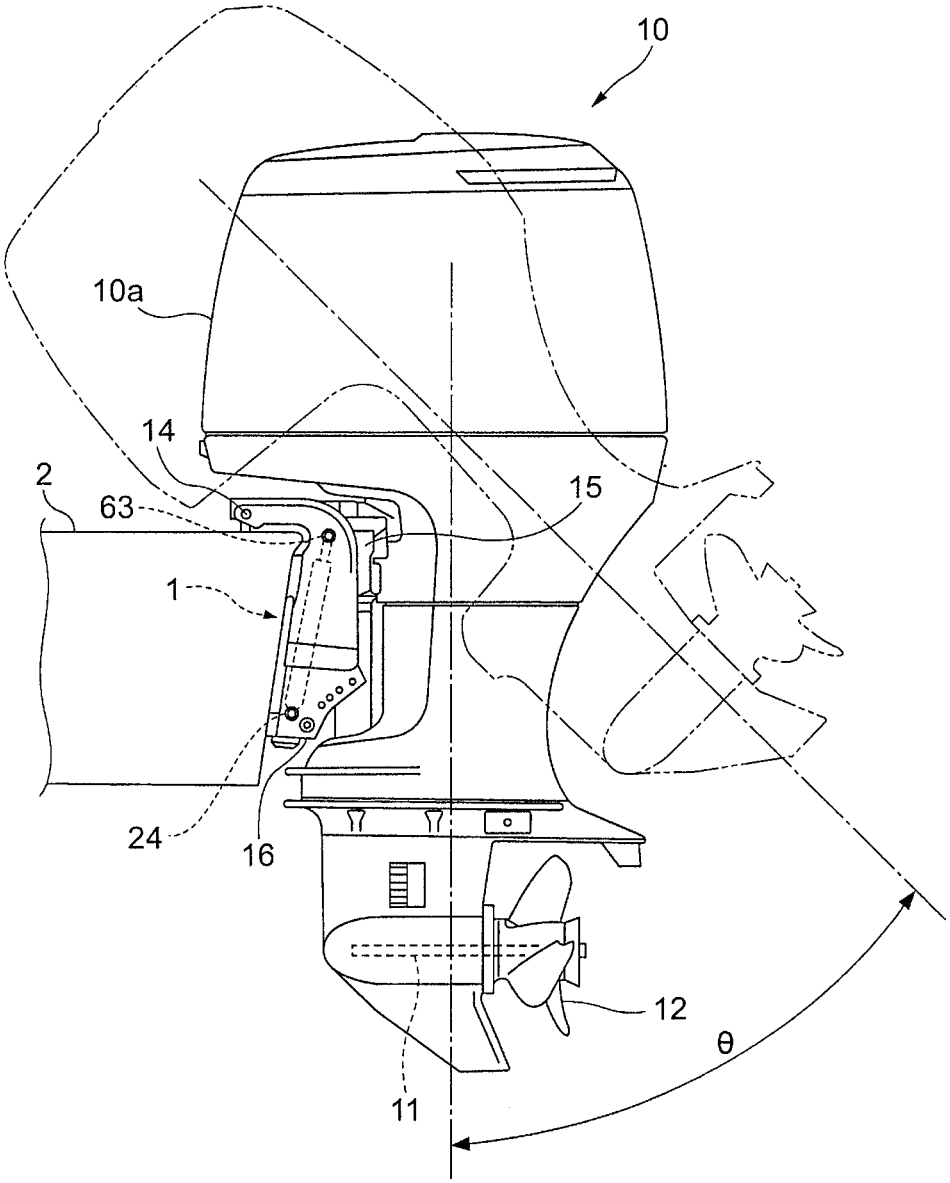
FIG. 1 is a schematic configuration view of a marine vessel propulsion machine in which a trim and tilt apparatus according to an embodiment of the invention is employed.

FIG. 1 is a schematic configuration view of a marine vessel propulsion machine 10 in which a trim and tilt apparatus 1 according to an embodiment of the invention is employed.

The marine vessel propulsion machine 10 includes a marine vessel propulsion machine main body 10*a* which generates a propulsion force to a ship body 2 of a ship, and the trim and tilt apparatus 1 which adjusts an inclination angle θ of a marine vessel propulsion machine main body 10*a* with respect to the ship body 2.

Schematic Configuration of Marine Vessel Propulsion Machine Main Body 10*a*

The marine vessel propulsion machine main body 10*a* includes an engine (not illustrated) which is placed so that the axial direction of a crank shaft (not illustrated) is directed toward the direction (upward-and-downward direction in FIG. 1) orthogonal to a water surface, and a drive shaft (not illustrated) which is rotatably integrally linked to a lower end of the crank shaft, and extends perpendicularly downward. In addition, the marine vessel propulsion machine main body 10*a* includes a propeller shaft 11 which is linked to the drive shaft via a bevel gear mechanism, and a propeller 12 which is mounted at a rear end of the propeller shaft 11.

In addition, the marine vessel propulsion machine main body 10*a* includes a swivel shaft (not illustrated) provided in the direction orthogonal (upward-and-downward direction in FIG. 1) to the water surface, a horizontal shaft 14 which is provided in the direction horizontal to the water surface, and a swivel case 15 in which the swivel shaft is freely rotatably accommodated. The swivel case 15 is linked to a pin hole 63*a* of a piston rod 60 of a cylinder device 100 which will be described later of the trim and tilt apparatus 1, by a pin (not illustrated).

Schematic Configuration of Trim and Tilt Apparatus 1

Figure 2:
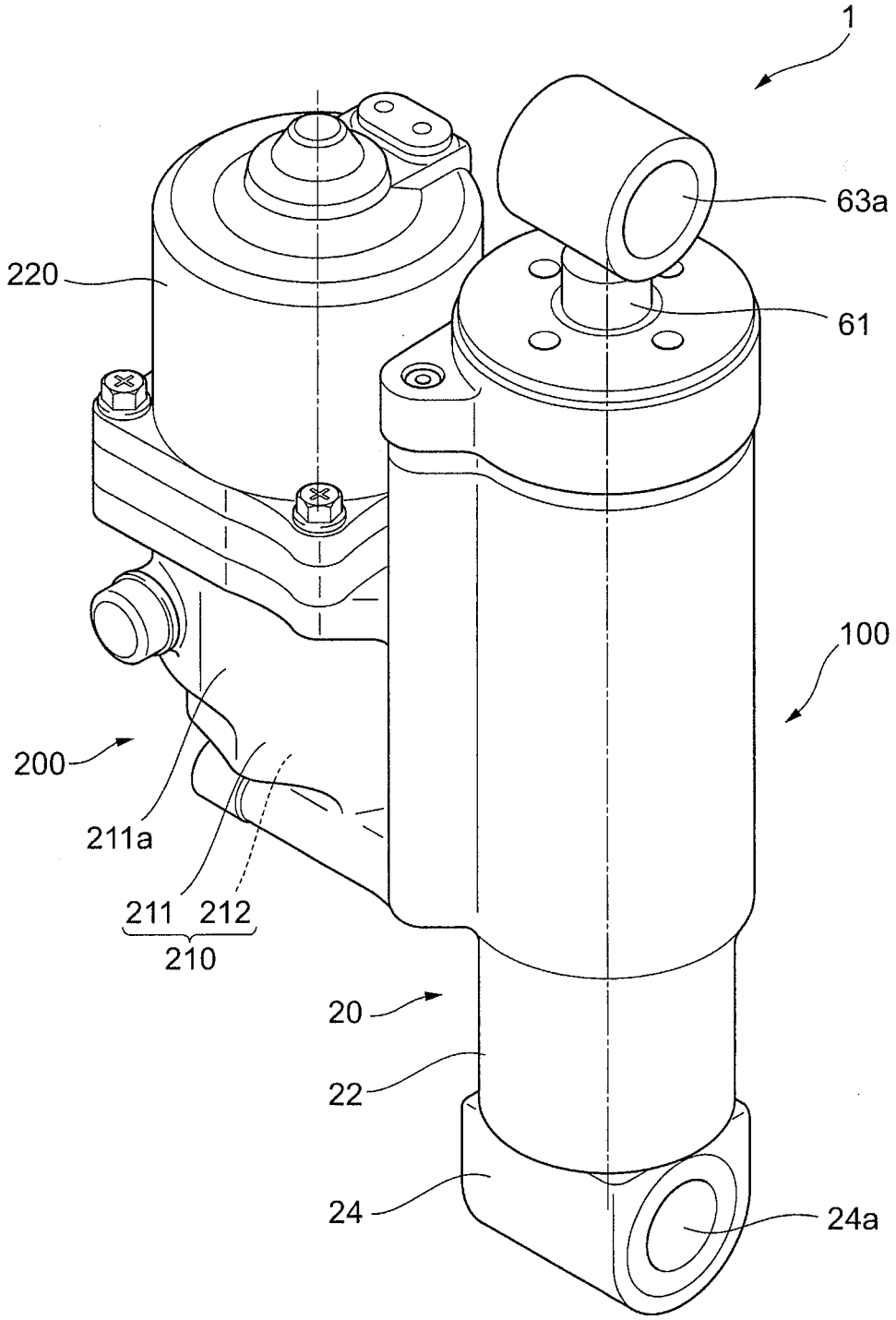
FIG. 2 is an outer view of the trim and tilt apparatus.

FIG. 2 is an outer view of the trim and tilt apparatus 1.

Figure 3:
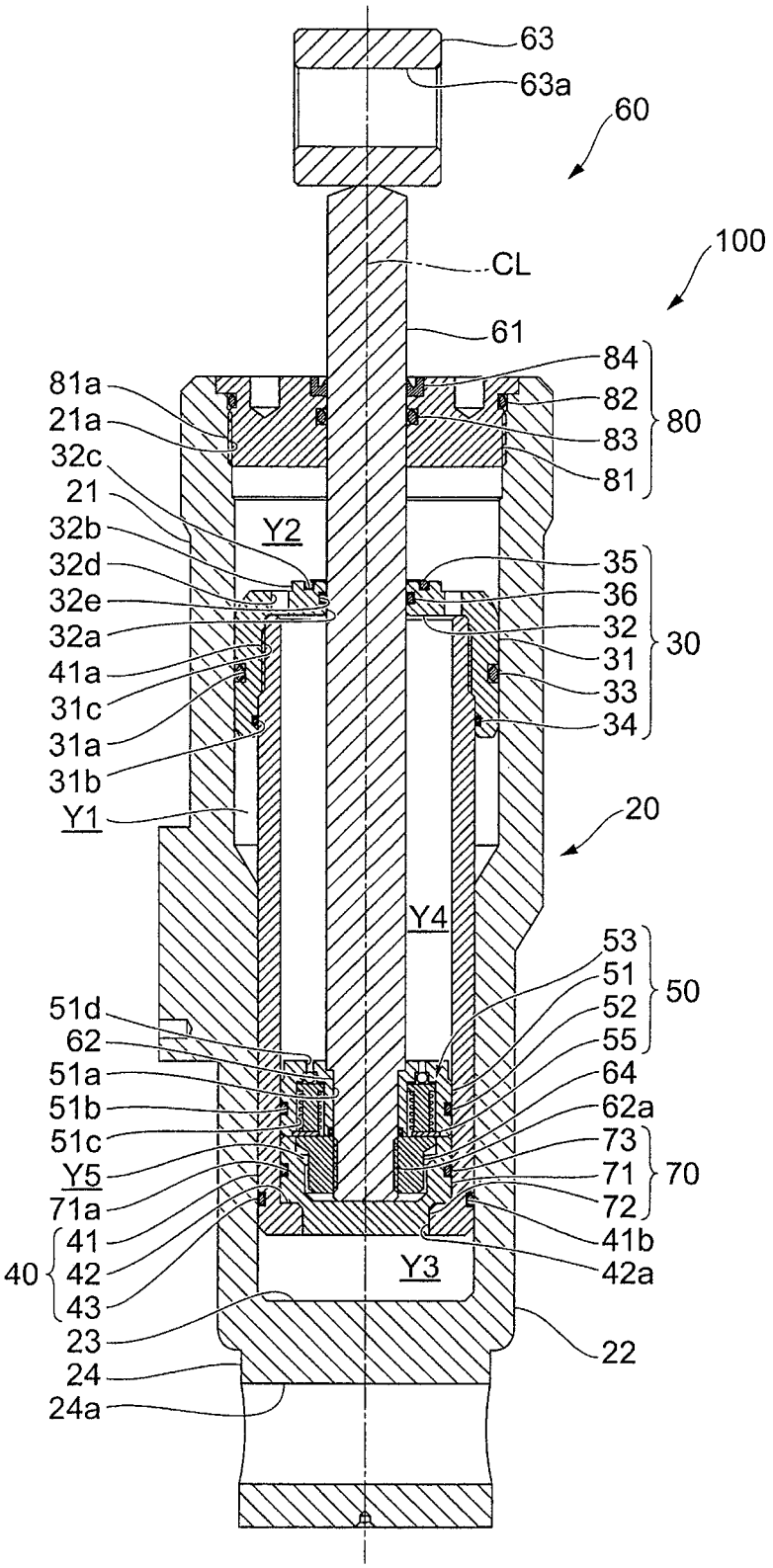
FIG. 3 is a partial sectional view of a cylinder device.

FIG. 3 is a partial sectional view of the cylinder device 100.

As illustrated in FIGS. 2 and 3, the trim and tilt apparatus 1 is provided with the cylinder device 100 which extends and contracts according to the feeding and discharging of oil which is an example of working fluid, and a feeding and discharging device 200 which feeds the oil to the cylinder device 100 or discharges the oil from the cylinder device 100.

In addition, the trim and tilt apparatus 1 is provided with a stern bracket 16 (refer to FIG. 1) which connects the swivel case 15 of the marine vessel propulsion machine main body 10*a* to the ship body 2. The stern bracket 16 is linked to a pin hole 24*a* of an outer cylinder 20 which will be described later, by a pin (not illustrated).

Cylinder Device 100

The cylinder device 100 includes the outer cylinder 20 having a cylinder that extends in the shaft center CL direction, and an outer piston 30 which is disposed inside the outer cylinder 20, and divides an inner space of the outer cylinder 20. In addition, the cylinder device 100 includes an inner cylinder 40 which is disposed inside the outer cylinder 20, and an inner piston 50 which is disposed inside the inner cylinder 40, and divides an inner space of the inner cylinder 40. In addition, the cylinder device 100 holds the inner piston 50 in one end portion in the shaft center CL direction, and includes the piston rod 60 which moves in the shaft center CL direction with respect to the inner cylinder 40 together with the inner piston 50. In addition, the cylinder device 100 includes a free piston 70 which moves in the inner cylinder 40 in the shaft center CL direction, and a cap 80 which covers an opening portion of the outer cylinder 20.

Hereinafter, in a case of referring to a specific direction in the shaft center CL direction of the outer cylinder 20, the downward direction in FIG. 3 is referred to as "downward", and the upward direction in FIG. 3 is referred to as "upward".

Outer Cylinder 20

The outer cylinder 20 includes a first cylindrical portion 21 and a second cylindrical portion 22 which are in a cylindrical shape and in which each of inner diameters and outer diameters are different from each other. In addition, the outer cylinder 20 includes a bottom portion 23 which blocks a lower end portion in the second cylindrical portion 22, and a protrusion portion 24 which protrudes downward from the bottom portion 23.

The outer diameter of the first cylindrical portion 21 is greater than the outer diameter of the second cylindrical portion 22, and the inner diameter of the first cylindrical portion 21 is greater than the inner diameter of the second cylindrical portion 22. The first cylindrical portion 21 is provided on the upper side of the second cylindrical portion 22. In an upper end portion of the first cylindrical portion 21, the inner diameter becomes greater than the inner diameter of a region with which an O ring 33 which will be described later of the outer piston 30 comes into contact, and a female screw 21*a* which is fastened with a male screw 81*a* formed in the cap 80 is formed on the inner circumferential surface.

In the protrusion portion 24, the pin hole 24*a* into which a pin (not illustrated) for being connected to the stern bracket 16 of the marine vessel propulsion machine main body 10*a* is inserted is formed.

Outer Piston 30

Figure 4:
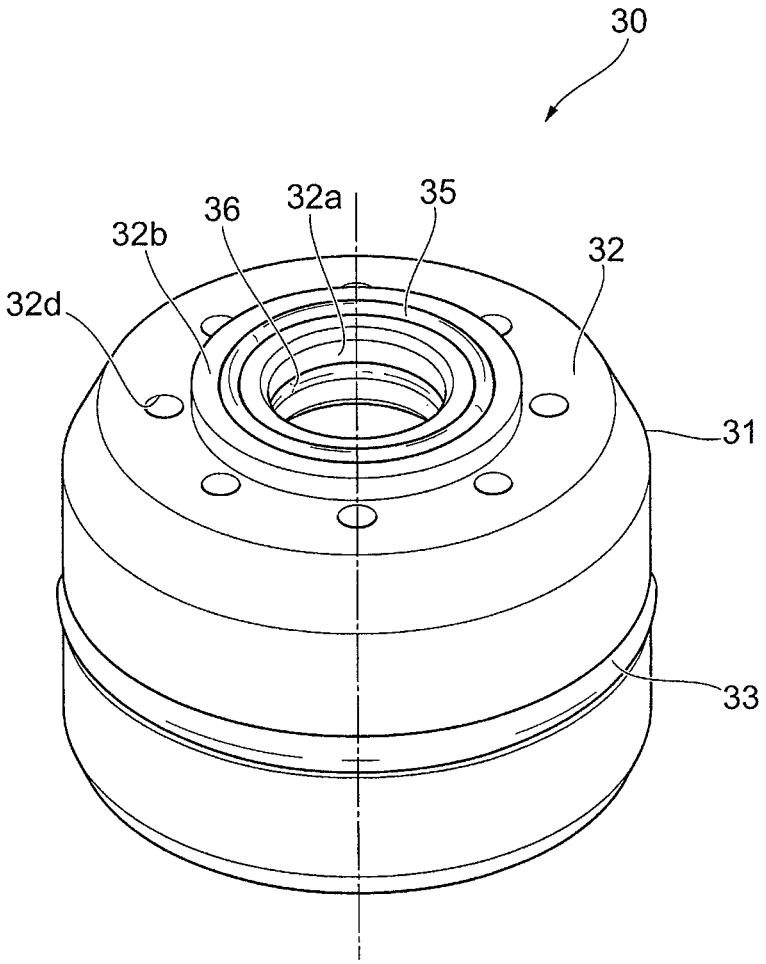
FIG. 4 is a perspective view of an outer piston.

FIG. 4 is a perspective view of the outer piston 30.

The outer piston 30 includes a cylindrical portion 31 having a cylindrical shape, and a head portion 32 which blocks the upper end portion in the cylindrical portion 31. In addition, the outer piston 30 includes the O ring 33 which is disposed between the outer piston 30 and the inner circumferential surface of the outer cylinder 20, an O ring 34 which is disposed between the outer piston 30 and the outer circumferential surface of the inner cylinder 40, an O ring 35 which is disposed between the outer piston 30 and the lower end surface of the cap 80, and an O ring 36 which is disposed between the outer piston 30 and the outer circumferential surface of the piston rod 60.

On the outer circumferential surface of the cylindrical portion 31, a groove 31*a* is recessed across the entire circumference is formed. The O ring 33 is fitted to the groove 31*a*. On the inner circumferential surface of the cylindrical portion 31, a groove 31*b* is recessed across the entire circumference is formed. The O ring 34 is fitted to the groove 31*b*.

In addition, on the inner circumferential surface of the cylindrical portion 31 and above the recessed groove 31*b*, a female screw 31*c* which is fastened by a male screw 41*a* that is formed in the upper end portion of the inner cylinder 40 and will be described later is formed. The outer piston 30 is held by the inner cylinder 40 as the female screw 31*c* formed in the cylindrical portion 31 is fastened by the male screw 41*a* formed in the inner cylinder 40.

The head portion 32 has a shape of a doughnut in which a through hole 32*a* having a diameter which is greater than the outer diameter of a first columnar portion 61 that will be described later of the piston rod 60 is formed in a center portion. A projection 32*b* which protrudes upward from the upper end surface is provided in the periphery of the through hole 32*a* in the upper portion of the head portion 32. In the upper portion of the projection 32*b*, a circular groove 32*c* recessed from the upper end surface is formed. The O ring 35 is fitted to the groove 32*c*.

In the periphery of the projection 32*b* in the head portion 32, a plurality (for example, eight) of through holes 32*d* in the shaft center CL direction are formed at an equal interval in the circumferential direction. The through hole 32*d* is formed on the more inner side than the cylindrical portion 31. In addition, the through hole 32*d* is formed so that at least a part is disposed on the more inner side than the inner cylinder 40 which holds the outer piston 30.

A groove 32e which is recessed across the entire circumference is formed on the inner circumferential surface of the head portion 32 which forms the through hole 32*a*. The O ring 36 is fitted to the groove 32e.

Inner Cylinder 40

The inner cylinder 40 includes a cylindrical portion 41 having a cylindrical shape, a bottom portion 42 which blocks the lower end portion in the cylindrical portion 41, and an O ring 43 which is disposed between the inner cylinder 40 and the inner circumferential surface of the outer cylinder 20.

On the outer circumferential surface of the upper end portion of the cylindrical portion 41, the male screw 41*a* which is fastened by the female screw 31*c* formed in the cylindrical portion 31 of the outer piston 30 is formed. In addition, on the outer circumferential surface of the lower end portion of the cylindrical portion 41, a groove 41*b* which is recessed across the entire circumference is formed. The O ring 43 is fitted to the groove 41*b*.

In the center portion of the bottom portion 42, a through hole 42*a* in the shaft center CL direction is formed.

Inner Piston 50

The inner piston 50 includes a piston main body 51 having a cylindrical shape, and an O ring 52 which is disposed between the inner piston 50 and the inner circumferential surface of the outer cylinder 20. In addition, the inner piston 50 includes a relief valve device 53 which allows inflow of the oil to a fifth chamber Y5 which will be described later from a fourth chamber Y4 which will be described later, and suppresses the inflow of the oil to the fourth chamber Y4 from the fifth chamber Y5. In addition, the inner piston 50 includes a return valve device 54 (refer to FIG. 5) which allows the inflow of the oil to the fourth chamber Y4 which will be described later from the fifth chamber Y5 which will be describe later, and suppresses the inflow of the oil to the fifth chamber Y5 from the fourth chamber Y4. In addition, the inner piston 50 includes a suppressing member 55 which suppresses disengagement of the relief valve device 53 and the return valve device 54.

In the piston main body 51, a through hole 51*a* in the shaft center CL direction is formed in the center portion. The piston rod 60 passes through the through hole 51*a*. In addition, in the piston main body 51, a groove 51*b* which is recessed across the entire circumference is formed. The O ring 52 is fitted to the groove 51*b*.

In addition, in the piston main body 51, a recessed portion 51*c* which is recessed in a columnar shape in the shaft center CL direction from the lower end surface, and a communication hole 51*d* in the axial direction which communicates with the recessed portion 51*c* and the upper part of the piston main body 51 are formed. The plurality (for example, four) of recessed portions 51*c* and the communication holes 51*d* are formed at an equal interval in the circumferential direction. The relief valve device 53 is accommodated in the recessed portion 51*c*, the suppressing member 55 is fitted to the opening portion on the lower end side of the recessed portion 51*c*.

In addition, in the piston main body 51, the recessed portion (not illustrated) which is recessed in a columnar shape in the shaft center CL direction from the upper end surface, and the communication hole (not illustrated) which communicates with the recessed portion and the lower part of the piston main body 51 in the axial direction are formed. At least one recessed portion and at least one communication hole may be formed in the circumferential direction. The return valve device 54 is accommodated in the recessed portion, and the suppressing member 55 is fitted to the opening portion on the lower end side of the recessed portion.

The relief valve device 53 includes a spherical valve body, a coil spring, and an intervening member having a T-shaped cut surface which is a surface that passes through the shaft center CL disposed between the valve body and the coil spring. In a case where the pressure of the fourth chamber Y4 which will be described later and the pressure of the fifth chamber Y5 which will be described later are equal to each other, and in a case where the pressure of the fifth chamber Y5 is greater than the pressure of the fourth chamber Y4, the valve body receives a spring force of the coil spring, blocks the opening portion of the communication hole 51*d*, and prevents the oil between the fifth chamber Y5 and the fourth chamber Y4 from circulating. In a case where the pressure of the fourth chamber Y4 is greater than the pressure of the fifth chamber Y5, the valve body moves downward against the spring force of the coil spring, opens the opening portion of the communication hole 51*d*, and allows the inflow of the oil to the fifth chamber Y5 from the fourth chamber Y4.

The suppressing member 55 is a disk-shaped member, and the plurality of through holes in the shaft center CL direction are formed.

The return valve device 54 has a spherical valve body.

Piston Rod 60

The piston rod 60 includes the first columnar portion 61 having a columnar shape, a second columnar portion 62 which has a columnar shape, is provided below the first columnar portion 61, and has a diameter which is smaller than the diameter of the first columnar portion 61, and a connection portion 63 which is provided above the first columnar portion 61, and is connected to the swivel case 15 of the marine vessel propulsion machine main body 10*a*.

The diameter of the first columnar portion 61 is greater than the inner diameter of the through hole 51*a* of the inner piston 50.

The diameter of the second columnar portion 62 is smaller than the inner diameter of the through hole 51*a* of the inner piston 50. A male screw 62*a* is formed in the lower end portion of the second columnar portion 62. The piston rod 60 holds the inner piston 50 as a flange nut 64 is fastened by the male screw 62*a* in a state where the second columnar portion 62 is inserted into the through hole 51*a* of the inner piston 50. The position of the inner piston 50 in the shaft center CL direction is determined as the inner piston 50 abuts against the lower end surface of the first columnar portion 61.

In the connection portion 63, a pin hole 63*a* into which the pin (not illustrated) for being connected to the swivel case 15 of the marine vessel propulsion machine main body 10*a* is formed.

Free Piston 70

The free piston 70 includes a cylindrical portion 71 having a cylindrical shape, a columnar bottom portion 72 which blocks the lower end portion in the cylindrical portion 71, and an O ring 73 which is disposed between the free piston 70 and the inner circumferential surface of the inner cylinder 40.

On the outer circumferential surface of the cylindrical portion 71, a groove 71*a* which is recessed across the entire circumference is formed. The O ring 73 is fitted to the groove 71*a*. The inner circumferential surface of the cylindrical portion 71 is formed in a stepped shape to be along the shape of a flange portion and a hexagonal portion of the flange nut 64. In addition, as illustrated in FIG. 3, in a state where the lower end surface of the inner piston 50 is in contact with the upper end surface of the cylindrical portion 71 of the free piston 70, the flange nut 64 is accommodated inside the cylindrical portion 71.

The diameter of the bottom portion 72 is smaller than the through hole 42*a* formed in the center portion of the bottom portion 42 of the inner cylinder 40, and in a state where the lower end surface of the cylindrical portion 71 is in contact with the upper end surface of the bottom portion 42 of the inner cylinder 40, the bottom portion 72 is fitted to the through hole 42*a* formed in the bottom portion 42 of the inner cylinder 40.

Cap 80

The cap 80 includes a cap main body 81 which is a cylindrical member in which the through hole in the shaft center CL direction for making the piston rod 60 pass therethrough is formed in the center portion. In addition, the cap 80 includes an O ring 82 which is disposed between the cap 80 and the inner circumferential surface of the outer cylinder 20, an O ring 83 which is disposed between the cap 80 and the outer circumferential surface of the piston rod 60, and an oil seal 84 provided above the O ring 83. On the outer circumferential surface of the cap main body 81, the male screw 81*a* which is fastened by the female screw 21*a* formed in the first cylindrical portion 21 of the outer cylinder 20 is formed.

Regarding First Chamber Y1, Second Chamber Y2, Third Chamber Y3, Fourth Chamber Y4, and Fifth Chamber Y5

As the O ring 33 of the outer piston 30 comes into contact with the inner circumferential surface of the first cylindrical portion 21 of the outer cylinder 20 and seals a gap between the outer piston 30 and the outer cylinder 20, the space which is the inside of the outer cylinder 20 and the outside of the inner cylinder 40 and the outer piston 30 is divided.

In addition, the O ring 34 of the outer piston 30 comes into contact with the outer circumferential surface of the cylindrical portion 41 of the inner cylinder 40, and seals the gap between the outer piston 30 and the inner cylinder 40. In addition, the O ring 43 of the inner cylinder 40 comes into contact with the inner circumferential surface of the second cylindrical portion 22 of the outer cylinder 20, and seals a gap between the outer circumferential surface of the cylindrical portion 41 of the inner cylinder 40 and the inner circumferential surface of the second cylindrical portion 22 of the outer cylinder 20.

Hereinafter, a space surrounded by the O ring 33 and the O ring 34 of the outer piston 30, the O ring 43 of the inner cylinder 40, the cylindrical portion 31 of the outer piston 30, the inner surface of the outer cylinder 20, and the outer surface of the inner cylinder 40 is referred to as a first chamber Y1.

In addition, the O ring 82 of the cap 80 comes into contact with the inner circumferential surface of the first cylindrical portion 21 of the outer cylinder 20, and seals a gap between the inner circumferential surface of the first cylindrical portion 21 of the outer cylinder 20 and the outer circumferential of the cap main body 81. In addition, the O ring 83 of the cap 80 comes into contact with the outer circumferential surface of the first columnar portion 61 of the piston rod 60, and seals a gap between the outer circumferential surface of the first columnar portion 61 of the piston rod 60 and the inner circumferential surface of the cap main body 81. In addition, the O ring 36 of the outer piston 30 comes into contact with the outer circumferential surface of the first columnar portion 61 of the piston rod 60, and seals a gap between the outer circumferential surface of the first columnar portion 61 of the piston rod 60 and the inner circumferential surface of the head portion 32 of the outer piston 30.

Hereinafter, a space surrounded by the O ring 33 and the O ring 36 of the outer piston 30, the O ring 82 and the O ring 83 of the cap 80, the outer surface of the outer piston 30, the inner circumferential surface of the head portion 32 of the outer piston 30, the inner surface of the outer cylinder 20, the outer surface of the piston rod 60, and the cap 80 is referred to as a second chamber Y2.

The O ring 52 of the inner piston 50 comes into contact with the inner circumferential surface of the cylindrical portion 41 of the inner cylinder 40, and seals a gap between the inner piston 50 and the inner cylinder 40. The O ring 73 of the free piston 70 comes into contact with the inner circumferential surface of the cylindrical portion 41 of the inner cylinder 40, and seals a gap between the free piston 70 and the inner cylinder 40.

Hereinafter, a space surrounded by the O ring 43 of the inner cylinder 40, the O ring 73 of the free piston 70, the inner surface of the outer cylinder 20, the inner cylinder 40, and the outer surface of the free piston 70 is referred to as a third chamber Y3.

Hereinafter, a space inside the inner cylinder 40, that is, a space surrounded by the O ring 52 of the inner piston 50, the O ring 36 of the outer piston 30, the inner surface of the inner cylinder 40, the inner surface of the outer piston 30, the outer surface of the piston rod 60, and the outer surface of the inner piston 50 is referred to as the fourth chamber Y4.

Hereinafter, a space inside the inner cylinder 40, that is, a space surrounded by the O ring 52 of the inner piston 50, the O ring 73 of the free piston 70, the inner surface of the inner cylinder 40, the inner piston 50, the flange nut 64, the piston rod 60, and the free piston 70 is referred to as the fifth chamber Y5.

Regarding Position of 0 Ring 35 of Outer Piston 30

In a case where the O ring 35 of the outer piston 30 comes into contact with the lower end surface of the cap main body 81 of the cap 80, the O ring 35 seals the gap between the upper end surface of the outer piston 30 and the cap 80. In addition, as the O ring 35 seals the gap, the second chamber Y2 surrounded by the inner surface of the outer cylinder 20, the outer surface of the outer piston 30, the cap 80, the piston rod 60, and the like is divided into a sixth chamber Y6 (refer to FIG. 6C) which is a space on the more inner side (center side) than the O ring 35, and a seventh chamber Y7 (refer to FIG. 6C) which is a space on the more outer side than the O ring 35.

In addition, in the cylinder device 100 according to the embodiment, the position of the O ring 35 is set so that a pressure receiving area of the inner piston 50 is greater than a pressure receiving area of the outer piston 30 which receives the pressure from the oil of the seventh chamber Y7.

The cylinder device 100 configured as described above is linked to the stern bracket 16 via the pin hole 24*a* of the protrusion portion 24 of the outer cylinder 20, and is linked to the swivel case 15 via the pin hole 63*a* of the connection portion 63 of the piston rod 60. As the cylinder device 100 extends and contracts, the distance between the stern bracket 16 and the swivel case 15 changes. In addition, as the distance between the stern bracket 16 and the swivel case 15 changes, the inclination angle θ of the marine vessel propulsion machine main body 10*a* with respect to the ship body 2 changes.

Feeding and Discharging Device 200

Figure 5:
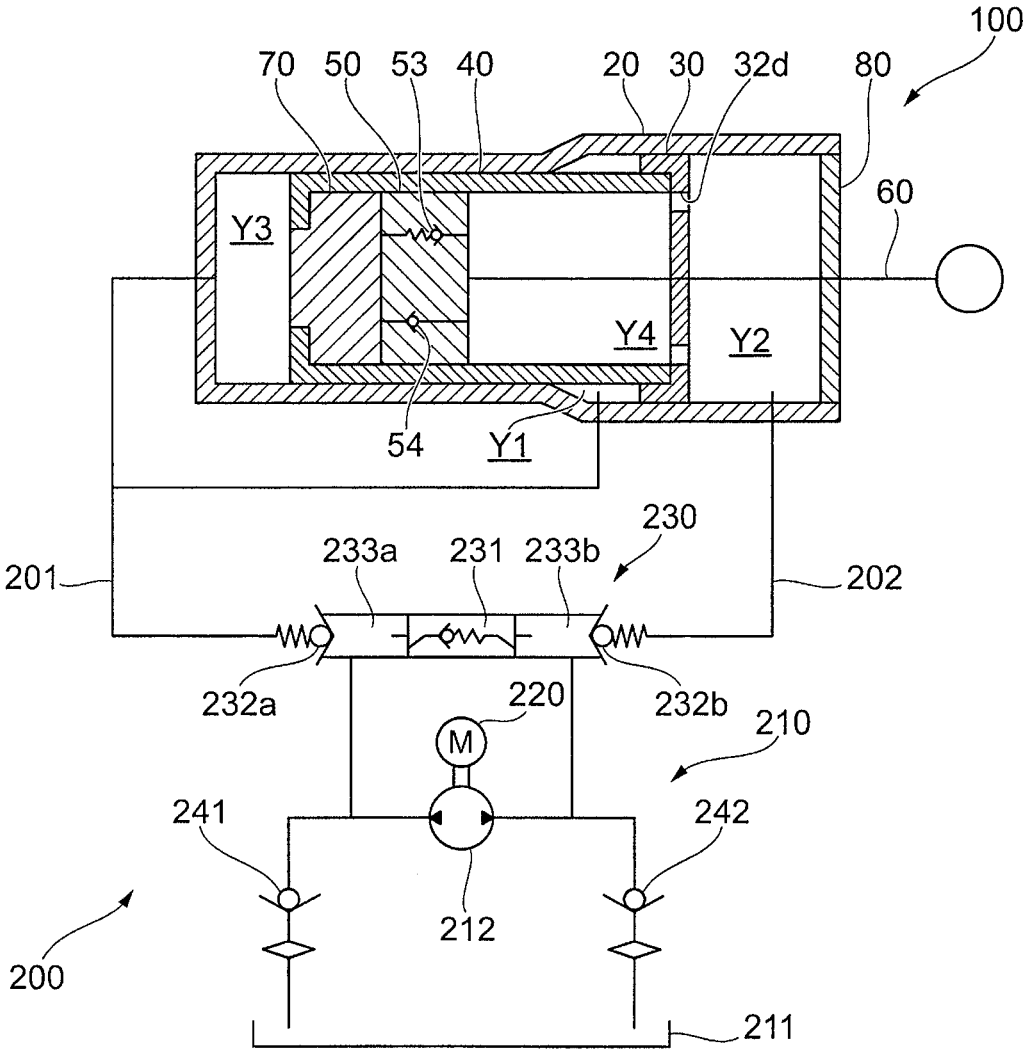
FIG. 5 is a schematic view of a hydraulic circuit of a feeding and discharging device.

FIG. 5 is a schematic view of a hydraulic circuit of the feeding and discharging device 200.

The feeding and discharging device 200 includes a pump device 210 which discharges the oil, a motor 220 which drives the pump device 210, a shuttle type switching valve 230 which switches a flow path formed between the pump device 210 and the cylinder device 100, and check valves 241 and 242.

Pump Device 210

The pump device 210 includes a tank 211 (refer to FIG. 2) which stores the oil therein, and a pump 212 which is disposed in the tank 211 and discharges the oil stored in the tank 211.

As illustrated in FIG. 2, the tank 211 includes a housing 211*a* and a tank chamber (not illustrated) which is a space surrounded by the housing 211*a* and the motor 220.

The housing 211*a* has a shape of a bottomed cylinder of which an upper part is open, and is fastened to the outer cylinder 20 of the cylinder device 100 by a bolt. In addition, in the housing 211*a* and the outer cylinder 20, a hole which configures the first flow path 201 that connects the pump 212 and the first chamber Y1 and the third chamber Y3 of the cylinder device 100 to each other is formed. In addition, in the housing 211*a* and the outer cylinder 20, a hole which configures a second flow path 202 that connects the pump 212 and the second chamber Y2 of the cylinder device 100 to each other is formed. In a case where the O ring 35 of the outer piston 30 comes into contact with the lower end surface of the cap main body 81 of the cap 80, the opening portion of the second chamber Y2 in the second flow path 202 is formed at a position of supplying the oil to the above-described seventh chamber Y7.

The pump 212 is a reversible gear pump which normally and reversely rotates.

In addition, the tank 211 may be formed to be integrated with the outer cylinder 20 of the cylinder device 100.

Motor 220

The motor 220 is a reversible motor which normally and reversely rotate.

The motor 220 is fixed to the housing 211*a* to block the opening portion of the upper portion of the housing 211*a* (refer to FIG. 2) of the pump device 210 in a liquid tight manner. The motor 220 is linked to the pump 212 in which a driving shaft is disposed in the tank chamber, and drives the pump 212 to rotate by being driven to rotate.

Shuttle Type Switching Valve 230

The shuttle type switching valve 230 includes a shuttle piston 231, and a first check valve 232*a* and a second check valve 232*b* which are disposed on both sides of the shuttle piston 231. In addition, in the shuttle type switching valve 230, a first shuttle chamber 233*a* is formed on the first check valve 232*a* side of the shuttle piston 231, and a second shuttle chamber 233*b* is formed on the second check valve 232*b* side of the shuttle piston 231.

The first check valve 232*a* is disposed on the first flow path 201 which connects the pump 212 and the first chamber Y1 and the third chamber Y3 of the cylinder device 100 to each other, and opens the first flow path 201 by oil sending pressure applied to the first shuttle chamber 233*a* by the normal rotation of the pump 212.

The second check valve 232*b* is disposed on the second flow path 202 which connects the pump 212 and the second chamber Y2 of the cylinder device 100 to each other, and opens the second flow path 202 by oil sending pressure applied to the second shuttle chamber 233*b* by the reverse rotation of the pump 212.

Check Valves 241 and 242

The check valves 241 and 242 are valves which are disposed in an intermediate portion of a connection flow path which connects the pump 212 and the tank 211 to each other, allow the pump 212 to suction the oil stored in the tank 211, and prevent the oil discharged from the pump 212 from reaching the tank 211.

Action of Trim and Tilt Apparatus 1

Trim Up/Tilt Up

Figure 6A:
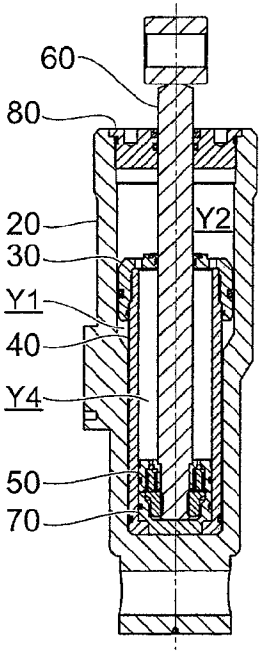
FIG. 6A is a view illustrating a state where the cylinder device fully contracts.
Figure 6B:
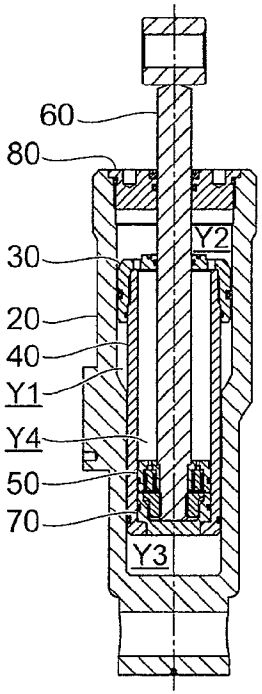
FIG. 6B is a view illustrating a state where the cylinder device makes slightly trimming up.
Figure 6C:
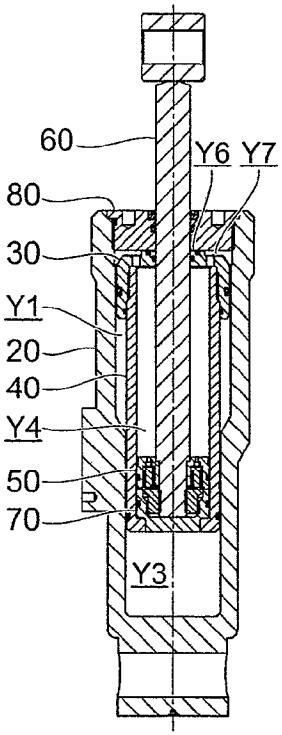
FIG. 6C is a view illustrating a state where the cylinder device makes fully trimming up.
Figure 6D:
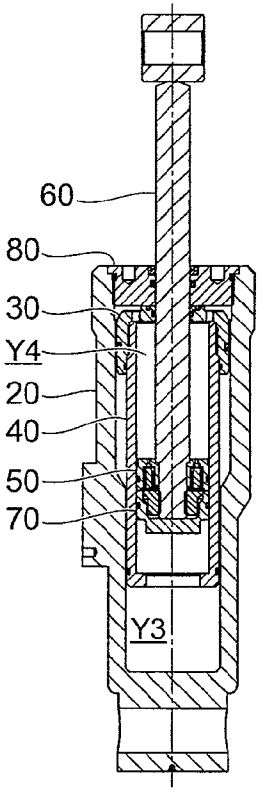
FIG. 6D is a view illustrating a state where the cylinder device makes slightly tilting up.
Figure 6E:
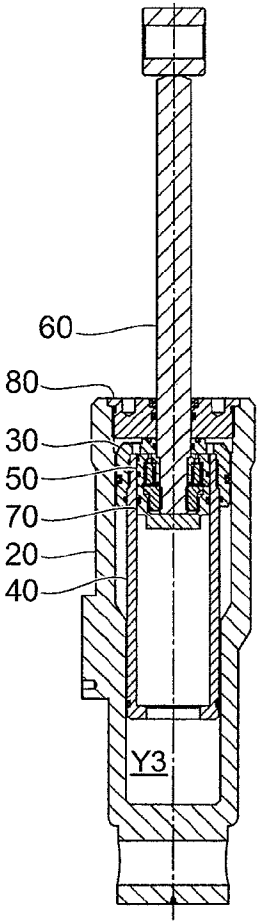
FIG. 6E is a view illustrating a state where the cylinder device makes fully tilting up.

FIG. 6A is a view illustrating a state where the cylinder device 100 fully contracts. FIG. 6B is a view illustrating a state where the cylinder device 100 makes slightly trimming up. FIG. 6C is a view illustrating a state where the cylinder device 100 makes fully trimming up. FIG. 6D is a view illustrating a state where the cylinder device 100 makes slightly tilting up. FIG. 6E is a view illustrating a state where the cylinder device 100 makes fully tilting up.

In a state where the cylinder device 100 fully contracts (state of FIG. 6A), when the motor 220 and the pump 212 normally rotate, the oil discharged from the pump 212 flows in the first chamber Y1 and the third chamber Y3 of the cylinder device 100 via the first flow path 201. In addition, the oil of the second chamber Y2 is suctioned by the pump 212. The oil which flows in the first chamber Y1 presses the outer piston 30 upward with respect to the outer cylinder 20.

At this time, since a force which presses the piston rod 60 downward acts due to a weight of the marine vessel propulsion machine main body 10*a*, the force which is directed downward acts on the inner piston 50 and the free piston 70. Therefore, even when the oil flows in the third chamber Y3, the free piston 70, the inner piston 50, and the piston rod 60 do not move upward with respect to the inner cylinder 40. As a result, as illustrated in FIG. 6B, the outer piston 30, the inner cylinder 40, the free piston 70, the inner piston 50, and the piston rod 60 integrally move upward with respect to the outer cylinder 20. In this manner, the cylinder device 100 makes trimming up.

When the motor 220 and the pump 212 continue to normally rotate after the cylinder device 100 is started to make trimming up, until the outer piston 30 abuts against the cap 80, the outer piston 30, the inner cylinder 40, the free piston 70, the inner piston 50, and the piston rod 60 integrally move upward with respect to the outer cylinder 20. As illustrated in FIG. 6C, a state where the outer piston 30 abuts against the cap 80 is a state where the cylinder device 100 makes fully trimming up.

In addition, a range from a position where the cylinder device 100 fully contracts, as illustrated in FIG. 6A, to a position where the outer piston 30, the inner cylinder 40, the free piston 70, the inner piston 50, and the piston rod 60 integrally move with respect to the outer cylinder 20 and the outer piston 30 abuts against the cap 80, as illustrated in FIG. 6C, is the trim range.

When the motor 220 and the pump 212 continue to normally rotate after the cylinder device 100 makes fully trimming up, since the outer piston 30 and the inner cylinder 40 cannot move upward, as illustrated in FIG. 6D, the oil which flows in the third chamber Y3 moves the free piston 70, the inner piston 50, and the piston rod 60 upward with respect to the inner cylinder 40. In this manner, the cylinder device 100 makes tilting up.

When the motor 220 and the pump 212 continue to normally rotate after the cylinder device 100 is started to make tilting out, until the inner piston 50 abuts against the outer piston 30, the free piston 70, the inner piston 50, and the piston rod 60 moves upward with respect to the inner cylinder 40. As illustrated in FIG. 6E, a state where the inner piston 50 abuts against the outer piston 30 is a state where the cylinder device 100 makes fully tilting up, and a state where the cylinder device 100 fully extends.

In addition, a range where from a position where the outer piston 30, the inner cylinder 40, the free piston 70, the inner piston 50, and the piston rod 60 are integrated with each other and move with respect to the outer cylinder 20, and the outer piston 30 abuts against the cap 80, as illustrated in FIG. 6C, to a position where the cylinder device 100 fully extends, as illustrated in FIG. 6E, is a tilt range.

Tilt Down/Trim Down

Figure 7A:
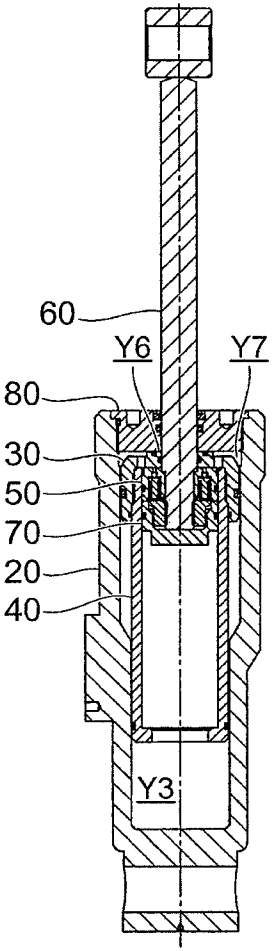
FIG. 7A is a view illustrating a state where the cylinder device makes fully tilting up.
Figure 7B:
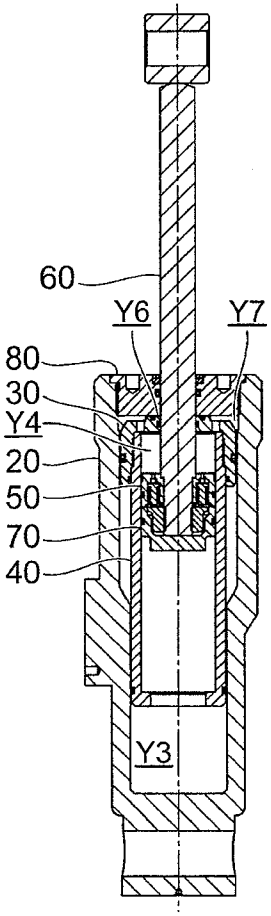
FIG. 7B is a view illustrating a state where the cylinder device makes slightly tilting down.
Figure 7C:
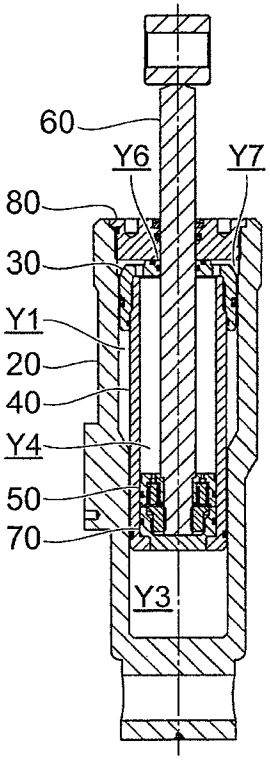
FIG. 7C is a view illustrating a state where the cylinder device makes fully tilting down.
Figure 7D:
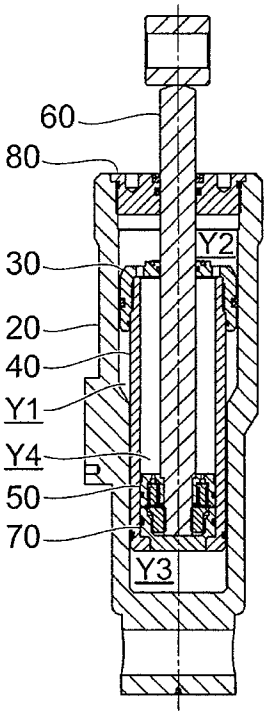
FIG. 7D is a view illustrating a state where the cylinder device makes slightly trimming down.
Figure 7E:
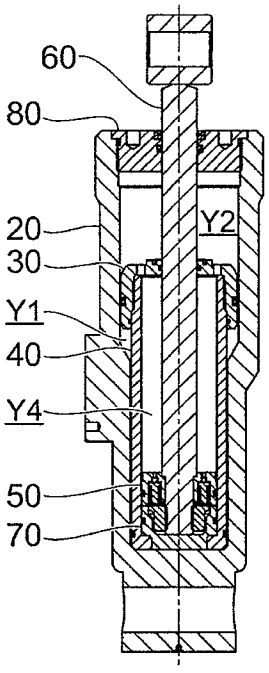
FIG. 7E is a view illustrating a state where the cylinder device makes fully trimming down.

FIG. 7A is a view illustrating a state where the cylinder device 100 makes fully tilting up. FIG. 7B is a view illustrating a state where the cylinder device 100 makes slightly tilting down. FIG. 7C is a view illustrating a state where the cylinder device 100 makes fully tilting down. FIG. 7D is a view illustrating a state where the cylinder device 100 makes slightly trimming down. FIG. 7E is a view illustrating a state where the cylinder device 100 makes fully trimming down.

In a state where the cylinder device 100 makes fully tilting up (state of fully extending) (state of FIG. 7A), when the motor 220 and the pump 212 reversely rotate, the oil discharged from the pump 212 flows in the second chamber Y2 of the cylinder device 100 via the second flow path 202. In addition, the oil of the first chamber Y1 and the third chamber Y3 is suctioned by the pump 212. The second chamber Y2 and the fourth chamber Y4 communicate with each other via the through hole 32*d* (refer to FIG. 3) formed in the head portion 32 (refer to FIG. 3) of the outer piston 30. At this time, as described above, since the pressure receiving area of the inner piston 50 is greater than the pressure receiving area of the outer piston 30 which receives the pressure from the oil of the seventh chamber Y7 in the second chamber Y2, as illustrated in FIG. 7B, the inner piston 50, the free piston 70, and the piston rod 60 move downward with respect to the inner cylinder 40. In this manner, the cylinder device 100 makes tilting down.

Even when the motor 220 and the pump 212 reversely rotate, and the oil which flows in the second chamber Y2 flows in the fourth chamber Y4 via the through hole 32*d* (refer to FIG. 3) formed in the outer piston 30 after the cylinder device 100 is started to make tilting down, since the O ring 36 of the outer piston 30 seals the gap between the outer piston 30 and the outer circumferential surface of the piston rod 60, the oil of the fourth chamber Y4 does not flow in the sixth chamber Y6. Therefore, when the motor 220 and the pump 212 continue to reversely rotate after the cylinder device 100 is started to make tilting down, until the free piston 70 abuts against the bottom portion 42 (refer to FIG. 3) of the inner cylinder 40, the inner piston 50, the free piston 70, and the piston rod 60 move downward with respect to the inner cylinder 40. As illustrated in FIG. 7C, a state where the free piston 70 abuts against the bottom portion 42 of the inner cylinder 40 is a state where the cylinder device 100 makes fully tilting down.

Even when the motor 220 and the pump 212 continue to reversely rotate after the cylinder device 100 makes fully tilting down, the inner piston 50, the free piston 70, and the piston rod 60 do not move downward with respect to the inner cylinder 40. Therefore, when the motor 220 and the pump 212 continue to reversely rotate after the cylinder device 100 makes fully tilting down, as illustrated in FIG. 7D, the oil which flows in the second chamber Y2 and the oil which flows in the fourth chamber Y4 via the through hole 32*d* of the outer piston 30 move the outer piston 30, the inner cylinder 40, the free piston 70, the inner piston 50, and the piston rod 60 which are integrated with each other downward with respect to the outer cylinder 20. In this manner, the cylinder device 100 makes trimming down.

When the motor 220 and the pump 212 continue to reversely rotate after the cylinder device 100 is started to make trimming down, until the inner cylinder 40 abuts against the bottom portion 23 (refer to FIG. 3) of the outer cylinder 20, the outer piston 30, the inner cylinder 40, the free piston 70, the inner piston 50, and the piston rod 60 are integrated with each other, and move downward with respect to the outer cylinder 20. As illustrated in FIG. 7E, a state where the inner cylinder 40 abuts against the bottom portion 23 of the outer cylinder 20 is a state where the cylinder device 100 makes fully trimming down.

When Impact is Absorbed

Figure 8A:
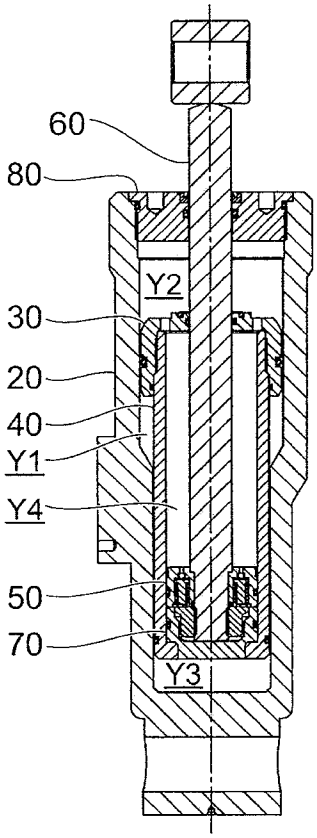
FIG. 8A is a view illustrating a state where the outer piston is stopped at a position in a trim range.
Figure 8B:
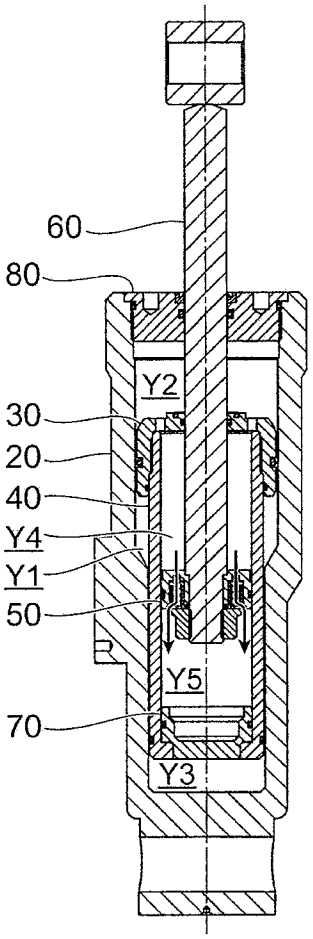
FIG. 8B is a view illustrating an initial state where an impulsive force is started to be absorbed.
Figure 8C:
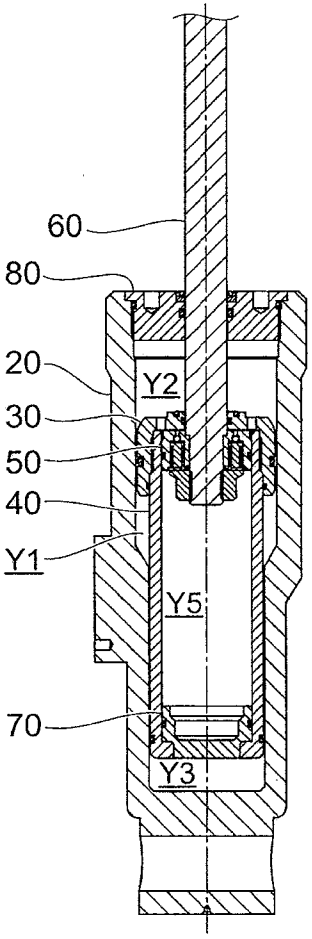
FIG. 8C is a view illustrating a state of a case where the impulsive force cannot be fully absorbed by movement of an inner piston and a piston rod with respect to an inner cylinder.
Figure 8D:
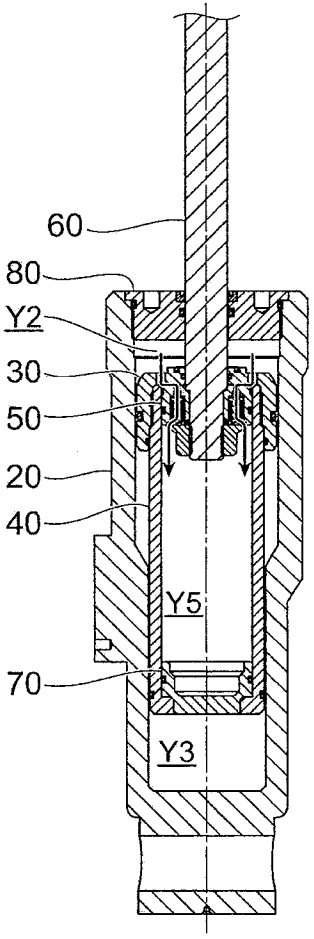
FIG. 8D is a view illustrating a state where the impulsive force is mainly absorbed by the outer piston.

FIG. 8A is a view illustrating a state where the outer piston 30 is stopped at a position in the trim range. FIG. 8B is a view illustrating an initial state where an impulsive force is started to be absorbed. FIG. 8C is a view illustrating a state of a case where the impulsive force cannot be fully absorbed by movement of the inner piston 50 and the piston rod 60 with respect to the inner cylinder 40. FIG. 8D is a view illustrating a state where the impulsive force is mainly absorbed by the outer piston 30.

When the ship body 2 sails forward, in a case where the motor 220 and the pump 212 are driven, and the cylinder device 100 ensures a forward travelling posture of the ship body 2 at a position in the trim range, the motor 220 and the pump 212 are stopped, and an oil amount of the cylinder device 100 is locked. In a state illustrated in FIG. 8A where the oil amount of the cylinder device 100 is locked, when the ship body 2 sails forward, in a case where the marine vessel propulsion machine 10 collides with underwater obstacles, such as driftwood, the impulsive force in the extending direction is applied to the piston rod 60 of the cylinder device 100. When the impulsive force in the extending direction is applied to the piston rod 60, the oil of the fourth chamber Y4 opens the valve body of the relief valve device 53 (refer to FIG. 5) of the inner piston 50, and flows in the fifth chamber Y5 between the inner piston 50 and the free piston 70. Accordingly, as illustrated in FIG. 8B, the piston rod 60 and the inner piston 50 move upward with respect to the inner cylinder 40, and absorb the impulsive force. At this time, the free piston 70 stays at a position illustrated in FIG. 8A at which the oil amount is locked, and the piston rod 60 and the inner piston 50 move upward with respect to the free piston 70.

In addition, if the absorption of the impulsive force caused by the collision with the underwater obstacles is finished by the movement upward of the piston rod 60 and the inner piston 50 with respect to the inner cylinder 40, the piston rod 60 and the inner piston 50 return to an original position (position at which the free piston 70 stays) by a self load of the marine vessel propulsion machine main body 10*a*. At this time, the oil of the fifth chamber Y5 between the inner piston 50 and the free piston 70 opens the return valve device 54 (refer to FIG. 5) of the inner piston 50, and flows in the fourth chamber Y4.

When the impulsive force caused by the collision with the underwater obstacles cannot be fully absorbed by the movement of the piston rod 60 and the inner piston 50 upward with respect to the inner cylinder 40, as illustrated in FIG. 8C, until the inner piston 50 abuts against the outer piston 30, the oil of the fourth chamber Y4 of which the pressure becomes high due to the impulsive force continues to open the valve body of the relief valve device 53 of the inner piston 50, and continues to flow in the fifth chamber Y5.

When the impulsive force caused by the collision with the underwater obstacles cannot be fully absorbed even when the inner piston 50 abuts against the outer piston 30, the oil of the second chamber Y2 of which the pressure becomes high due to the impulsive force flows in the fifth chamber Y5 via the through hole 32*d* of the outer piston 30 and the relief valve device 53 of the inner piston 50. Accordingly, as illustrated in FIG. 8D, the piston rod 60, the inner piston 50, the outer piston 30, and the inner cylinder 40 are integrated with each other, and absorb the impulsive force by the movement upward with respect to the outer cylinder 20. Since the outer piston 30 has the size by which the opening portion of the upper end portion of the inner cylinder 40 is covered in a state where the piston rod 60 is exposed, the pressure receiving area which receives the pressure of the oil of the second chamber Y2 is greater than the pressure receiving area which receives the pressure of the oil of the fourth chamber Y4. Therefore, an impact absorbing performance of the outer piston 30 is greater than an impact absorbing performance of the inner piston 50.

As described above, the trim and tilt apparatus 1 according to the embodiment includes the piston rod 60 which is an example of a bar-shaped rod having one end portion (upper end portion) that is attached to the marine vessel propulsion machine main body 10*a*, and the inner cylinder 40 which is an example of a first cylinder. In addition, the trim and tilt apparatus 1 includes the inner piston 50 which is an example of a first piston that is mounted on the other end portion (lower end portion) of the piston rod 60, is accommodated in the inner cylinder 40, and divides the space in the inner cylinder 40 into the fourth chamber Y4 which is an example of a first space on one end portion side and the fifth chamber Y5 which is an example of a second space on the other end portion side. In addition, the trim and tilt apparatus 1 includes the outer cylinder 20 which is an example of a second cylinder that accommodates the inner cylinder 40 therein, and the outer piston 30 which is an example of a second piston that covers the opening portion of one end portion of the inner cylinder 40 in a state where the piston rod 60 is exposed, divides the space in the outer cylinder 20 into the second chamber Y2 which is an example of a third space on the one end portion side and the first chamber Y1 which is an example of a fourth space on the other end portion side, and in which the through hole 32*d* which is an example of a communication hole that allows the fourth chamber Y4 and the second chamber Y2 to communicate with each other is formed.

When the ship body 2 sails forward, in a case of receiving the impulsive force in the direction (extending direction) in which the piston rod 60 protrudes from the inner cylinder 40, for example, in a case where the marine vessel propulsion machine 10 collides with the underwater obstacles, such as driftwood, and in a case where the impulsive force cannot be absorbed by the inner piston 50, the impulsive force is absorbed by the outer piston 30. Since the outer piston 30 has the size by which the opening portion of the upper end portion of the inner cylinder 40 is covered in a state where the piston rod 60 is exposed, the outer piston 30 is more unlikely to move than the inner piston 50, and the impact absorbing performance of the outer piston 30 is greater than the impact absorbing performance of the inner piston 50. In other words, even when the impulsive force cannot be fully absorbed by the inner piston 50, since the impulsive force is absorbed by the outer piston 30 of which the impact absorbing performance is large, compared to a trim and tilt apparatus having another configuration, the trim and tilt apparatus 1 according to the embodiment has a high capability of absorbing the impact. In other words, the trim and tilt apparatus 1 according to the embodiment can improve the capability of absorbing the impulsive force caused by the collision of the underwater obstacles with respect to the marine vessel propulsion machine 10.

In addition, since the through hole 32*d* which passes through the fourth chamber Y4 and the second chamber Y2 is formed in the outer piston 30, when the impulsive force is absorbed by the outer piston 30, the oil of the second chamber Y2 of which the pressure becomes high flows in the fifth chamber Y5 via the relief valve device 53 of the inner piston 50. Therefore, for example, the configuration here is simpler than a configuration in which the relief valve device which allows the inflow of the oil from the second chamber Y2 to the first chamber Y1 and suppresses the inflow of the oil to the second chamber Y2 from the first chamber Y1 is provided in the outer piston 30, and the impulsive force is absorbed by allowing the oil of the second chamber Y2 of which the pressure becomes high by receiving the impulsive force of the piston rod 60 in the extending direction to flow in the first chamber Y1.

In addition, the trim and tilt apparatus 1 according to the embodiment includes the cap 80 which is an example of a cover member that covers the opening portion of the upper end portion of the outer cylinder 20, and the outer piston 30 which comes into contact with the cap 80 and divides the chamber into the sixth chamber Y6 that is an example of an inner space on the more inner side than the through hole 32*d* and the seventh chamber Y7 that is an example of an outer space on the more outer side than the sixth chamber Y6.

Therefore, compared to a configuration in which the outer piston 30 does not divide the chamber into the sixth chamber Y6 and the seventh chamber Y7, when the cylinder device 100 makes tilting down from a state of making fully tilting up (state of fully extending), malfunction in which the outer piston 30 moves is suppressed. In other words, as the outer piston 30 divides the chamber into the sixth chamber Y6 and the seventh chamber Y7, in a state where the cylinder device 100 makes fully tilting up, the pressure receiving area which receives the pressure of the oil that is discharged from the pump 212 and flows in the second chamber Y2 (seventh chamber Y7) via the second flow path 202 becomes smaller. Accordingly, compared to a piston which receives the pressure of the oil that flows in the second chamber Y2 via the second flow path 202 across the entire upper end surface without diving chamber into the sixth chamber Y6 and the seventh chamber Y7, the outer piston 30 according to the embodiment is unlikely to move downward when making tilting down from a state of making fully tilting up. As a result, in the trim and tilt apparatus 1 according to the embodiment, when the cylinder device 100 makes tilting down from a state of making fully tilting up, it is possible to suppress malfunction in which the outer piston 30 moves instead of the inner piston 50. In addition, it is possible to achieve the above-described effects by a simple configuration in which the O ring 35 that is an example of a sealing member that seals a gap between the outer piston 30 and the cap 80 when the outer piston 30 comes into contact with the cap 80 at a part opposing the cap 80 is provided.

In the outer piston 30, it is preferable that the pressure receiving area which receives the pressure of the seventh chamber Y7 is smaller than the pressure receiving area which receives the pressure of the seventh chamber Y7 in the inner piston 50. When the pressure receiving area of the outer piston 30 is smaller than the pressure receiving area of the inner piston 50, in a case where the oil is discharged from the pump 212 in a state of making fully tilting up, and flows in the second chamber Y2 (seventh chamber Y7) via the second flow path 202, the inner piston 50 moves downward with respect to the inner cylinder 40 with high accuracy. Therefore, when the cylinder device 100 makes tilting down from a state of making fully tilting up, it is possible to suppress malfunction in which the outer piston 30 moves instead of the inner piston 50 with high accuracy.

What is claimed is:

1. A trim and tilt apparatus for a marine vessel propulsion machine comprising:

a bar-shaped rod having one end portion that is attached to a marine vessel propulsion machine main body;

a first cylinder;

a first piston which is mounted in the other end portion of the rod, is accommodated in the first cylinder, and divides a space in the first cylinder into a first space on the one end portion side and a second space on the other end portion side;

a second cylinder which accommodates the first cylinder therein; and a second piston which covers an opening portion of one end portion of the first cylinder in a state where the rod is exposed, divides a space in the second cylinder into a third space on the one end portion side and a fourth space on the other end portion side, and is formed with a communication hole that allows the first space and the third space to communicate with each other, wherein a pressure receiving area of a region where the second piston receives a pressure of the third space is greater than a pressure receiving area of a region where the first piston receives the pressure of the third space.

2. The trim and tilt apparatus for a marine vessel propulsion machine according to claim 1, wherein a fluid in the third space is directed toward the first space via the communication hole of the second piston in a case of receiving a force in a direction in which the rod protrudes from the first cylinder.

3. The trim and tilt apparatus for a marine vessel propulsion machine according to claim 1, wherein a fluid in the third space is directed toward the first space via the communication hole of the second piston in a case of receiving a force in a direction in which the rod protrudes from the first cylinder.

4. The trim and tilt apparatus for a marine vessel propulsion machine according to claim 1, wherein the first piston includes a valve which allows the fluid in the first space to be directed toward the second space in a case of receiving the force in the direction in which the rod protrudes from the first cylinder.

5. The trim and tilt apparatus for a marine vessel propulsion machine according to claim 1, wherein the first piston includes a valve which allows the fluid in the first space to be directed toward the second space in a case of receiving the force in the direction in which the rod protrudes from the first cylinder.

6. The trim and tilt apparatus for a marine vessel propulsion machine according to claim 2, wherein the first piston includes a valve which allows the fluid in the first space to be directed toward the second space in a case of receiving the force in the direction in which the rod protrudes from the first cylinder.

7. The trim and tilt apparatus for a marine vessel propulsion machine according to claim 3, wherein the first piston includes a valve which allows the fluid in the first space to be directed toward the second space in a case of receiving the force in the direction in which the rod protrudes from the first cylinder.

8. The trim and tilt apparatus for a marine vessel propulsion machine according to claim 4, wherein a fluid in the third space opens the valve and is directed toward the second space in a case of receiving the force in a direction in which the rod protrudes from the first cylinder after the first piston comes into contact with the second piston.

9. The trim and tilt apparatus for a marine vessel propulsion machine according to claim 5, wherein a fluid in the third space opens the valve and is directed toward the second space in a case of receiving the force in a direction in which the rod protrudes from the first cylinder after the first piston comes into contact with the second piston.

10. The trim and tilt apparatus for a marine vessel propulsion machine according to claim 6, wherein a fluid in the third space opens the valve and is directed toward the second space in a case of receiving the force in a direction in which the rod protrudes from the first cylinder after the first piston comes into contact with the second piston.

11. The trim and tilt apparatus for a marine vessel propulsion machine according to claim 7, wherein a fluid in the third space opens the valve and is directed toward the second space in a case of receiving the force in a direction in which the rod protrudes from the first cylinder after the first piston comes into contact with the second piston.

12. A marine vessel propulsion machine comprising:

a marine vessel propulsion machine main body which gives a propulsion force to a ship body;

a bar-shaped rod having one end portion that is attached to the marine vessel propulsion machine main body;

a first cylinder;

a first piston which is mounted in the other end portion of the rod, is accommodated in the first cylinder, and divides a space in the first cylinder into a first space on the one end portion side and a second space on the other end portion side;

a second cylinder which accommodates the first cylinder therein; and a second piston which covers an opening portion of one end portion of the first cylinder in a state where the rod is exposed, divides a space in the second cylinder into a third space on the one end portion side and a fourth space on the other end portion side, and is formed with a communication hole that allows the first space and the third space to communicate with each other, wherein a pressure receiving area of a region where the second piston receives a pressure of the third space is greater than a pressure receiving area of a region where the first piston receives the pressure of the third space.

* * * * *